US006615846B1

(12) United States Patent
Leason et al.

(10) Patent No.: US 6,615,846 B1
(45) Date of Patent: Sep. 9, 2003

(54) HAIR WRAPPER WITH STACKABLE CARTRIDGES AND CARTRIDGES FOR THE SAME

(75) Inventors: David Leason, Chappaqua, NY (US); Edward J. Ellis, New York, NY (US); Eugene J. Lattuga, Bonita Springs, FL (US)

(73) Assignee: Elysee Beauty Products, Ltd., Kwai Chung (HK)

( * ) Notice: Subject to any disclaimer, the term of this patent is extended or adjusted under 35 U.S.C. 154(b) by 0 days.

(21) Appl. No.: 10/214,926

(22) Filed: Aug. 7, 2002

(51) Int. Cl.[7] ..... A45D 7/02; B65H 16/02

(52) U.S. Cl. ..... 132/212; 132/271; 57/13; 242/593; 242/594

(58) Field of Search ..... 57/13, 15, 3, 4, 57/5, 58.83; 87/33, 62; 242/442, 594, 593; 132/212, 271, 273, 56

(56) References Cited

U.S. PATENT DOCUMENTS

| | | | |
|---|---|---|---|
| 1,048,687 | A | 12/1912 | Goodrick |
| 1,392,611 | A | 10/1921 | Adams |
| 1,927,261 | A | 9/1933 | Evans |
| 2,792,775 | A | 5/1957 | Beyette |
| 3,259,370 | A | 7/1966 | Neale, Sr. |
| 4,038,996 | A | 8/1977 | Eronini et al. |
| 4,346,550 | A | 8/1982 | Ferree |
| 4,580,585 | A | 4/1986 | Sapkus |
| 4,583,561 | A | 4/1986 | Larsson |
| 4,824,036 | A | 4/1989 | Buta |
| 4,856,721 | A | 8/1989 | Bonello et al. |
| 5,404,892 | A | 4/1995 | Bretl |
| 5,456,271 | A | 10/1995 | Legette |
| 5,488,963 | A | 2/1996 | Fishman |
| 5,558,105 | A | 9/1996 | Rosenwinkel et al. |
| 5,671,759 | A | 9/1997 | Chung et al. |
| 5,810,022 | A | 9/1998 | Reynolds |
| 5,967,151 | A | 10/1999 | Villani et al. |
| 5,988,181 | A | 11/1999 | Gable et al. |
| 6,109,275 | A | 8/2000 | Mendezmonsanto |
| 6,318,378 | B1 | 11/2001 | Kennedy et al. |

FOREIGN PATENT DOCUMENTS

| | | |
|---|---|---|
| JP | 58-177683 | 10/1983 |
| JP | 02-104305 | 4/1990 |
| JP | 07-216678 | 8/1995 |
| JP | 08-052016 | 2/1996 |
| JP | 08-052017 | 2/1996 |
| JP | 3024761 | 3/1996 |
| JP | 3036455 | 1/1997 |
| JP | 10-033241 | 2/1998 |
| JP | 2001-218615 | 8/2001 |

OTHER PUBLICATIONS

U.S. patent application Ser. No. 10/216,371, Leason, filing date Aug. 9, 2002.

*Primary Examiner*—Kevin Shaver
*Assistant Examiner*—Stephanie Willatt
(74) *Attorney, Agent, or Firm*—Darby & Darby

(57) ABSTRACT

An apparatus for wrapping hair with a cord is provided and according to one embodiment includes a housing; a main spindle operatively coupled to the housing and one or more cartridges with one cartridge being operatively coupled to the main spindle and the other cartridges being operatively coupled to one another. Each cartridge contains a cord that is dispensed and wrapped around hair as a result of the rotation of the main spindle.

31 Claims, 6 Drawing Sheets

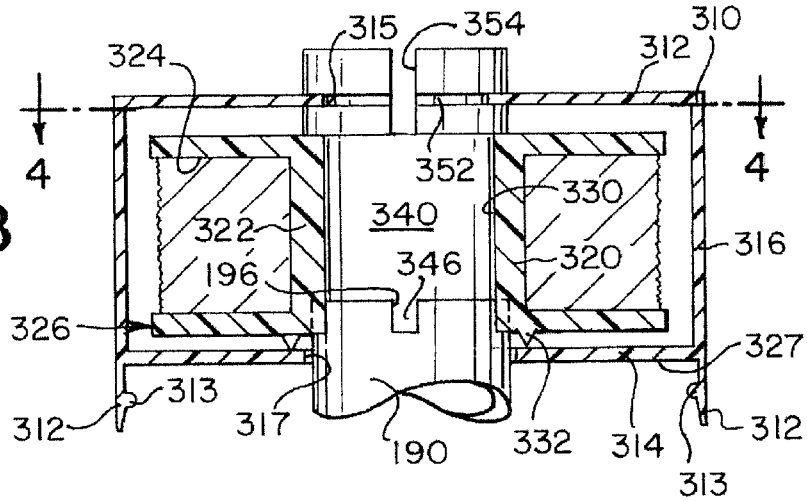
FIG. 3
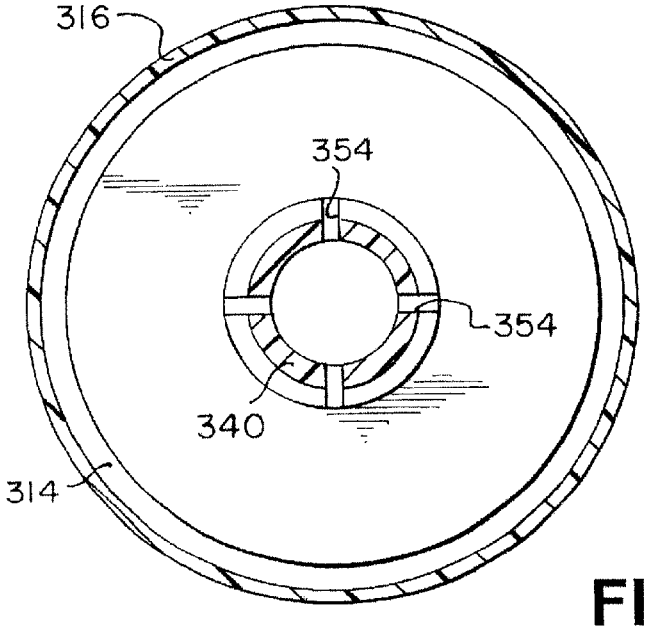
FIG. 4
FIG. 5
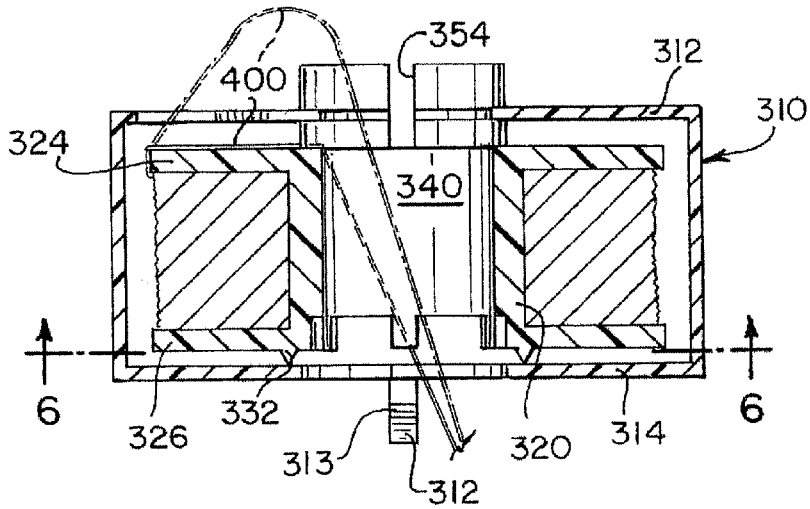

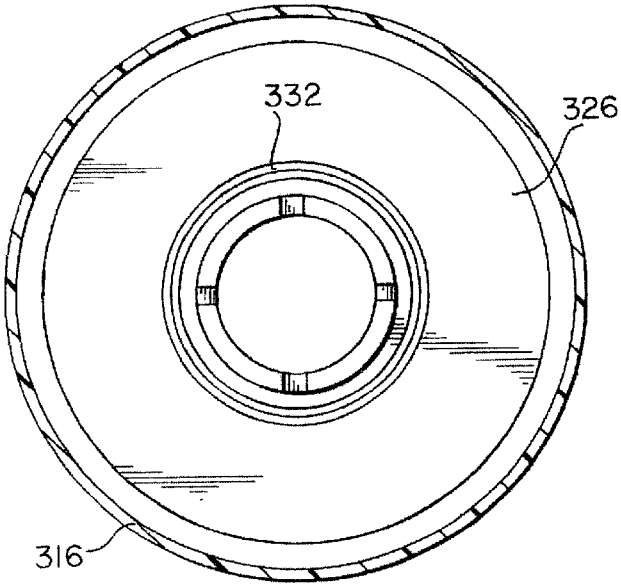
FIG. 6
FIG. 7
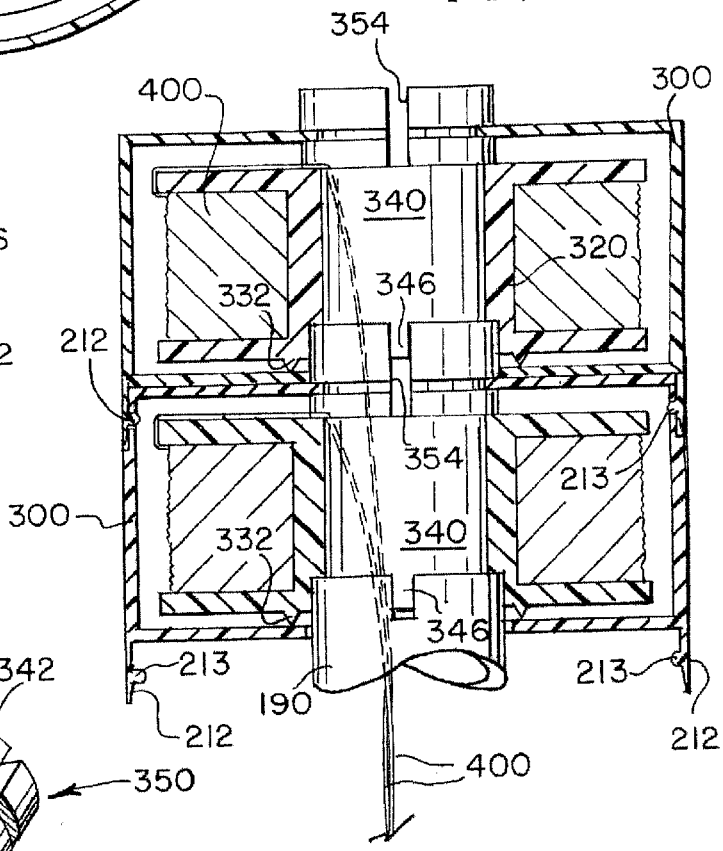
FIG. 8
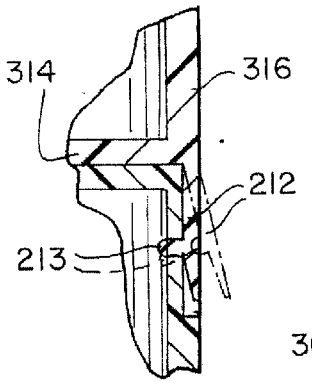
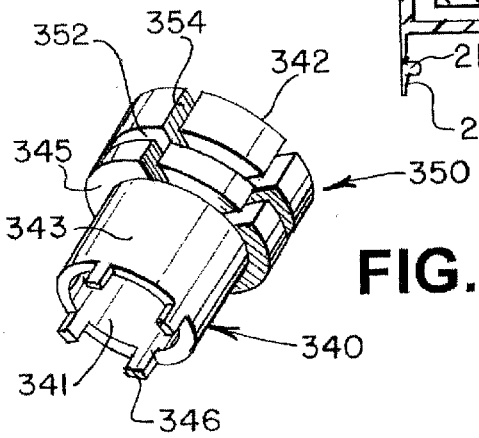
FIG. 9

HAIR WRAPPER WITH STACKABLE CARTRIDGES AND CARTRIDGES FOR THE SAME

TECHNICAL FIELD

The present invention relates to a device for wrapping hair with a cord, and more particularly, to a hand-held device that wraps hair with a cord as an adornment and which includes one or more stackable cartridges each containing a cord and each being constructed to mate either with the device or with another stackable cartridge.

BACKGROUND

Hair wrapping devices are known which wrap cords around locks of hair. For example, U.S. Pat. No. 5,671,759, which is incorporated herein by reference in its entirety, discloses a simple, compact hair wrapper that is inexpensive to build and operate. The device includes a housing; a spindle operatively joined to the housing and defining a spindle bore for receiving cord and hair. The spindle also can have a detent for receiving the cord. The apparatus has a spool defining a spool bore through which the spindle is disposed and also the spool receives and dispenses the cord. Means for rotating the spindle relative to the housing and spool is provided such that the cord is dispensed from the spool through any detent (or cord tensions) and the spindle bore, hair is disposed in the spindle bore, and the spindle is rotated to wrap the hair with cord. The spindle is rotatably mounted within a hollow spool chamber which is partially defined by a spool cover, and the spool is disposed in the hollow spool chamber such that it is rotatable around the spindle to unwind cord as needed. The dispensing cord extends from the spool upwardly and then threaded through the spindle opening that also receives the locks of hair. Thus, the spindle and spool are all self-contained within the hollow spool chamber.

This design is constructed for placing one spool around the spindle and therefore only one spool is used at one time during a hair wrapping procedure. Many times, it is desirable to wrap more than one cord around the locks of hair since this permits multiple colored cords to be used. Accordingly, one of the deficiencies of this type of device is that only one spool can be used at one time and thus the hair wrapping patterns are limited and also because the one spool is stored underneath the spool cover, the switching of spools requires several steps to be performed.

What has heretofore not been available is a hair wrapper that is designed to receive one or more cartridges that are each configured to mate with either the main hair wrapping device or another cartridge so that the user can selectively decide the number of cords to use and/or the colors of the cords.

SUMMARY

An apparatus for wrapping hair with a cord is provided and according to one embodiment includes a housing; a first gearing operatively coupled to the housing and one or more cartridges. The first gearing defines a main bore for receiving cord and hair and each cartridge includes second gearing and a rotatable spool for receiving and dispensing cord. The rotatable spool is driven by the second gearing which has a bore for receiving hair and cord from the spool and the second gearing has a guide (such as a slot) for receiving the cord and permitting the cord to be disposed through the bore of the second gearing.

The rotation of the first gearing causes cord to be dispensed through the guide and the bore of the second gearing and the main bore and hair is disposed through the main bore and the bore of the second gearing, and the rotation of the first gearing causes the cord to wrap around the hair.

In another embodiment, an apparatus is provided for wrapping hair with a cord. The apparatus includes a housing, a first gear operatively coupled to the housing such that the first gear is rotatably driven, and one or more cartridges that are operatively coupled to the first gear. The cartridge includes a drive spool that includes a drive gear formed as part thereof which is operatively coupled to the first gear so that the drive spool is driven by rotation of the first gear. The drive spool is coupled to a drive spindle that includes a drive spindle bore for receiving hair and cord from the spool, and the drive spindle has a slot for receiving the cord and permit the cord to be disposed through the drive spindle bore. The rotation of the drive spool causes cord to be dispensed through the guide and the drive spindle bore; hair is disposed through the drive spindle bore and the drive spool is rotated to wrap the hair with cord.

The above, and other objects, features and advantages of the present device will become apparent from the following description read in conjunction with the accompanying drawings, in which like reference numerals designate the same elements.

BRIEF DESCRIPTION OF THE DRAWING FIGURES

FIG. 3 is a cross-sectional view taken along the line 3—3 of FIG. 2;

FIG. 4 is a cross-sectional view taken along the line 4—4 of FIG. 3;

FIG. 5 is a cross-sectional view taken along the line 5—5 of FIG. 2;

FIG. 6 is cross-sectional view taken along the line 6—6 of FIG. 5;

FIG. 7 is a cross-sectional view of two stackable cord cartridges mated together and being coupled to a drive mechanism of the hair wrapper device;

FIG. 8 is an enlarged cross-sectional view of releasable locking mechanism for locking the cord cartridge of FIG. 2 to another cord cartridge;

FIG. 9 is perspective view of a rotatable spindle that forms a part of the cord cartridge of FIG. 2 and each such cord cartrige;

DETAILED DESCRIPTION OF PREFERRED EMBODIMENTS

Figure 1:
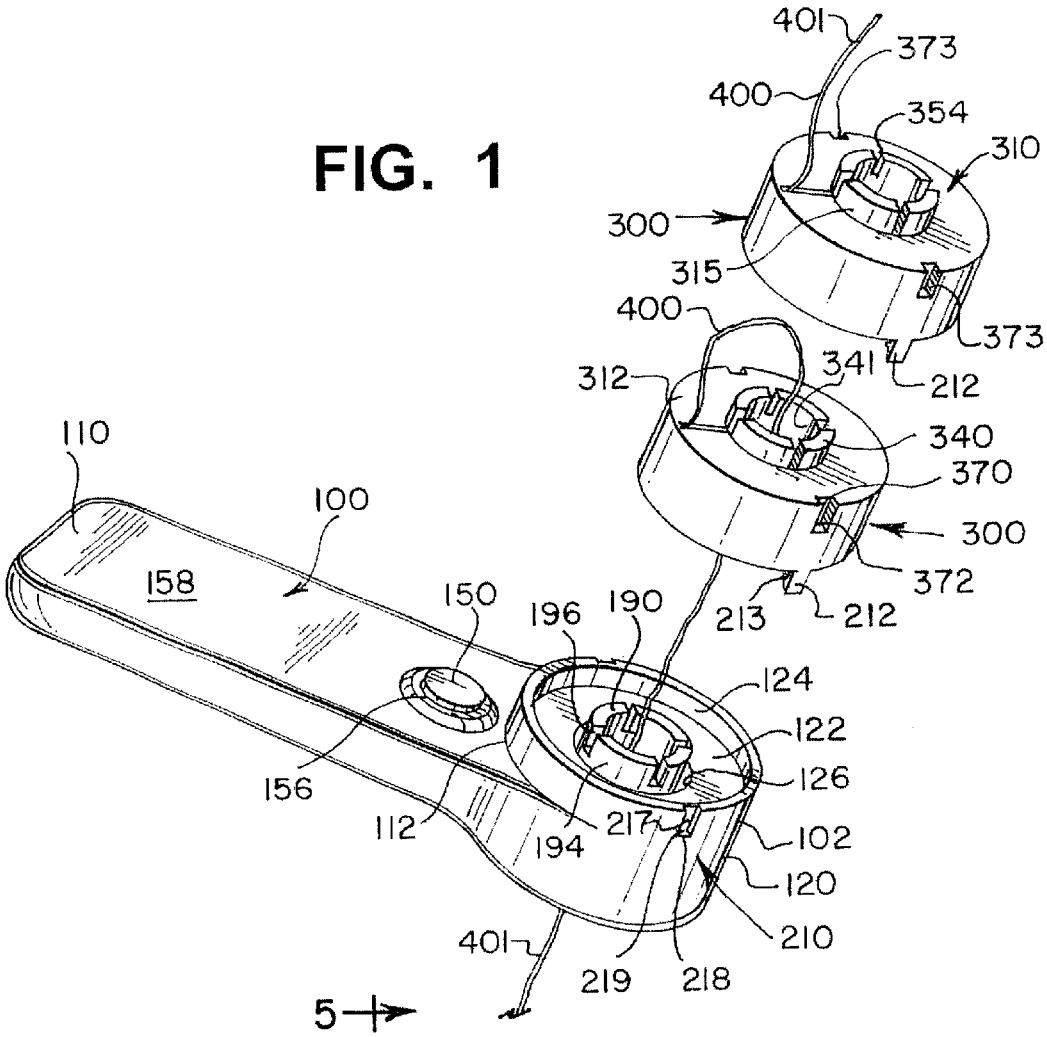
FIG. 1 is an exploded perspective view of a hair wrapper device with a plurality of stackable cord cartridges according to a first embodiment.

FIGS. 1–9 illustrate a hair wrapper assembly 10 according to a first embodiment. The hair wrapper assembly 10 includes a hair wrapper device 100 and a plurality of stackable cartridges 300. The hair wrapper device 100 has a number of similarities with the hair wrapping device disclosed in U.S. Pat. No. 5,671,759, which is hereby incorporated by reference in its entirety. The hair wrapping device 100 includes a handle portion 110 and a spindle base section 120 formed at a distal end 112 of the handle portion 110. Preferably, the spindle base section 120 is integrally formed with the handle portion 110 at distal end 112 and has dimensions (i.e., width) slightly greater than the handle portion 110. For example, the handle portion 110 can taper outwardly at the distal end 112 to form the spindle base section 120 which preferably has an arcuate shape and defines a distal end 102 of the hair wrapping device 100.

Much of the handle portion 110 and the spindle base section 120 is hollow and defines an interior compartment (indicated at 106 in FIG. 17) that stores many of the working components of the hair wrapping device 100. As will be described in greater detail hereinafter, the spindle base section 120 has a recessed floor 122 that is preferably planar with a peripheral rim 124 extending completely around the floor 122 at an outer peripheral edge thereof Preferably, the peripheral rim 124 is integrally formed as part of the spindle base section 120 such the distal end 112 of the handle portion 110 flows smoothly into the spindle base section 120. According to one exemplary embodiment, the peripheral rim 124 is generally annular in shape. The recessed floor 122 has an opening 126 formed in a central portion thereof and as a result, the recessed floor 122 generally has a ring-like shape with the peripheral rim 124 at an outer peripheral edge thereof and the opening 126 defining a peripheral inner edge thereof. The opening 126 provides access to an inner chamber of the spindle base section 120.

As best shown in FIGS. 1 and 7, the spindle base section 120 also includes a feature that forms a part of a locking mechanism, generally indicated at 210, to releasably lock one of the cartridges 300 to the spindle base section 120. The locking mechanism 210 can comprise any number of traditional locking mechanisms that are suitable for use in the spindle base section 120 to releasably lock one cartridge 300 thereto. For example, one exemplary locking mechanism 210 includes a male snap element 212 that is associated with the cartridge 300 that is shaped to engage a female snap element 217 formed in the spindle base section 120. One exemplary male snap element 212 is a tang having a locking feature 213 formed therealong for engaging a detent 217 (female snap element) formed in the spindle base section 120 in a releasably locking manner. More specifically, the detent 217 is a shaped cut-out formed in the spindle base section 120 and it extends downward from a top edge of the peripheral rim 124 and terminates in a ledge 218. Formed within the detent 217 is an opening or slot 219 that forms an entrance into the interior chamber that is defined underneath the floor 122. The opening 219 is formed slightly above the ledge 218 and has a complementary shape so that the locking feature 213 of the tang 212 is received therein in the locked position. The locking feature 213 is not formed at a distal end of the tang 212 but rather is formed proximate thereto so that when the locking feature 213 is received and engaged within the opening 219, the distal end of the tang 212 extends below the opening 219 but preferably does not extend all the way to the ledge 218. By providing a gap between the distal end of the tang 212 and the ledge 218, the user can grasp the distal end of the tang 212 even when the tang 212 is in the locked position (i.e., the locking feature 213 is disposed within the opening 219) for manually releasing the cartridge 300.

According to one embodiment, the locking feature 213 is a protrusion, rib, beveled member or the like that is shaped to be received within the opening 219. The tang 212 is a resilient member and therefore has some flexibility and is naturally biased inward so that when the tang 212 is received in the detent 217, the locking feature 213 will seat against the inner surface of the detent 217, resulting in the tang 212 flexing slightly outwardly. As the tang 212 travels within the detent 217 toward the ledge 218, the locking feature 213 becomes aligned with the opening 219 and is received therein to effectuate a releasably interlocking fit (e.g., snap fit) between the tang 212 and the detent 217. The tang 212 is naturally biased inwardly and therefore the locking feature 213 is biased and automatically received into the opening 219 to further locate and lock the cartridge 300 relative to the hair wrapper device 100 once these features are brought into alignment.

Figure 17:
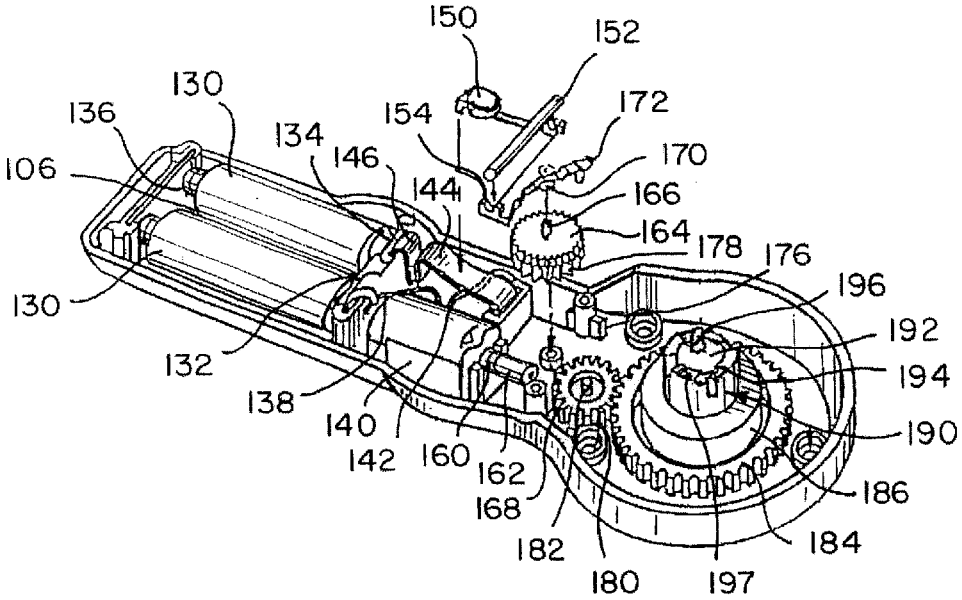
FIG. 17 is a cut-away perspective view of the hair wrapper device of FIG. 1 illustrating an exemplary drive mechanism thereof.

Now referring to FIG. 17 which illustrates the interior compartment 106 that houses most of the working components of the hair wrapper device 100. The handle portion 110 defines a hollow space that forms the part of the interior compartment 106 that is located within the handle portion 110. The hollow space 106 is illustrated as containing two AA size batteries 130 integrated into an electrical circuit by a positive contact 132, a negative contact 134 and ajumper contact 136. A wire lead 138 is joined to one positive contact and to a motor 140. Another wire lead 142 is connected to the motor 140 and to a button switch 144 made of resilient electrically conductive material. In the normal condition, the button switch 144 is up and spaced apart from a stationary contact 146 so that the circuit is open and the motor 140 is not energized. The stationary contact 148 is connected to the negative contact 134.

The button switch 144 can be pushed down by the button 150 which is preferably made of an insulating material and molded integrally with a pivot member 152 that rests in bearings 154. The button 150 is biased upward by the resilient button contact (switch) 144 in the normal condition. When pushed, the button 150 urges the resilient button contact 144 downward into electrical cummunication with the stationary contact 148 to close the circuit and energize the motor 140. The button 150 is accessible through a hole 156 formed in an upper surface 158 of the handle portion 110, preferably proximate distal end 112 for easy access by a thumb.

The motor 140 can be Mabuchi model FA-260RA, RE-260RA, RE140RA, or FA-130RA, or other suitable model. Further, the motor 140 can be powered by one or more batteries, or it can be powered interchangeably by one and two batteries to provide variable speed in the wrapping operation. A rocker switch can be used to dictate which of the two battery-powered modes will be used as understood by those of skill in the art.

The motor 140 includes a shaft 160 that rotates when the motor 140 is energized. Fixed to the shaft 160 for rotation therewith is a worm gear 162. Meshed with worm gear 162 is a worm gear follower 164 that spins on a gear shaft 166 that is rotatably fitted into a lower bearing 168 that is located in a lower housing half of the handle portion 110. The upper end of the gear shaft 166 rides in an upper bearing 170 molded integrally into a plate 172 that also includes the bearings 154 for the button pivot member 152. Two downwardly extending pins 174 (only one is illustrated) hold the plate 172 securely in place by nesting is sockets 176 or the like. For example, the handle portion 110 can be formed of a housing upper half and a housing lower half that are secured to one another and define the chamber 106.

Referring back to the gear shaft 166, there also is a spur gear 178 fixed to the shaft 166 beneath the worm gear follower 164 for rotational movement therewith. An idler gear 180 is meshed with the spur gear 178 and rotationally mounted in the housing using a shaft 182 and bearings (not illustrated). Meshed to the idler gear 180, is a drum gear 184 that is rotatably mounted to the lower housing half and molded integrally with a drum 186.

Alternative gear mesh arrangements could be used to transmit the rotary motion from the motor to the spindle, which one skilled in the art will appreciate. Further, a gear mesh can be used which incorporates a belt-drive which can reduce vibration, reduce noise, and provide a clutching mechanism which will slip when the spindle is restrained from rotating.

Molded integrally with and extending upward from the drum gear 184 is a reduced portion or spindle 190. The spindle 190 defines a bore 192 that extends between the top and bottom of the hollow chamber that is formed underneath the floor 122 (see FIG. 1). The spindle 190 has an upper section 194 that extends above the planar upper surface of the floor 122. In other words, the spindle 190 extends through the opening 126 formed in the floor 122 such that a portion of the spindle 190 extends above the planar upper surface of the floor 122. The upper section 194 preferably includes a plurality of detents 196 formed therein and separated by a plurality of flats 197 that serve to couple rotation of the spindle 190 to respective rive spindler 340 of one or more cartridges 300, as described below.

The number of detents 196 can be varied; however, the detents 196 are preferably evenly spaced apart from one another such that a distance between any two adjacent detents 196 is the same. Each detent 196 is a slot or cut-out formed in the upper section 194 from a top section thereof. For example, each detent 196 can have a generally rectangular shape with an upper end being open.

The relative height between the upper section 194 that extends above the floor 122 and the peripheral rim 124 can be varied; however, in one exemplary embodiment, the top of the spindle 190 does not extend above the peripheral rim 124. Preferably, the heights are approximately the same such that the top of the spindle 190 and the top of the peripheral rim 124 lie within the same plane. Preferably, the bottom of each detent 196 is located above the floor 122 so that the detent 196 does not extend within the opening 126 formed in the floor 122.

Because the spindle 190 forms a part of the drum gear 184 which is driven by the motor 140, the spindle 190 is likewise driven by the motor 140 in a rotating manner. By pushing the button 150, the electrical circuit is closed and the motor 140 is energized to rotate the spindle 190 through the gear mesh. When the spindle 190 rotates, the detents 196 will necessarily rotate since the detents 196 are formed in the spindle 190 itself.

The hair wrapper assembly 10 includes the plurality of stackable cartridges 300 that can interchangeable be used to effectively wrap a user's hair with one or more cords 301 that are each associated with one of the cartridges 300. One exemplary cartridge 300 is illustrated in FIGS. 1–9. The cartridge 300 includes a cartridge housing 310 that has an upper face 312, an opposing lower face 314 and a side 316 therebetween. The housing 310 is preferably formed of a plastic material such as a material that can be molded to form the housing 310. The housing 310 has a shape that is complementary to the spindle base section 120 and more particularly, the floor 122 and the peripheral rim 124 thereof, so that the cartridge 300 can be seated within the peripheral rim 124 proximate or upon the floor 122. The upper face 312 includes an opening 315 formed therein and the lower face 314 contains an opening 317 formed therein. The openings 316, 317 can have any number of shapes; however, the openings 316, 317 typically have circular shapes.

The cartridge 300 has two major components that are coupled to the spindle 190 so that the rotation of the spindle 190 causes the rotation of these two components. More specifically, the cartridge 300 has a rotatable spool 320 that is disposed within the housing 310. The spool 320 is designed to carry dispensing cord 400 and includes a base section 322 around which the cord 400 is wrapped and opposing top and bottom flange members 324, 326 that extend beyond the base section 322 and serve to help hold the cord 400 around the base section 322. In other words, the cord 400 is disposed between the top and bottom flange members 324, 326 around the base section 322. The base section 322 is a hollow member with a spool bore 330 being formed therethrough from one flange member 324 to the other flange member 326. A spacer/anti-friction member 332 is formed on the bottom of the flange member 326 that seats against a floor 327 of the housing 310 to permit the spool 320 to freely rotate within the housing 310. In one exemplary embodiment, the member 332 is an annular rib that is formed on the bottom of the flange member 326 as best shown in FIG. 6. Thus, when the spool 320 is disposed within the housing 310, there is a gap formed between the flange member 324 and the upper face 312 of the housing 310 and there is also a radial gap formed between the outermost edges of the flange members 324, 326 and the side 316 of the housing 310. The annular rib 332 seats against the floor 327 so as to define a frictional point between the spool 320 and the housing 310 and thus reduce the area of the spool 320 that is in frictional contact with the housing 310. By reducing the frictional area between the spool 320 and the housing 310, the spool 320 can more freely and efficiently rotate within the housing 310.

The cartridge 300 also includes a drive spindle 340 for causing rotation of the spool 320. One exemplary drive spindle 340 is best illustrated in FIG. 9. The drive spindle 340 is a hollow member that has a bore 341 formed therethrough from a first end 342 to an opposing second end 344 and includes an annular base section 343 having a reduced first diameter and terminating in the second end 344. The second end 344 has a number of protrusions 346 (e.g., interlocking feet) that extend outwardly therefrom. The feet 346 are preferably evenly spaced around the base section 343 at the second end 344 thereof. According to one exemplary embodiment, each foot 346 is a rectangular protrusion that extends outwardly from the second end 344.

The number of feet 346 and the dimensions of each foot 346 is such that the feet 346 serve as a means for coupling the cartridge 300 to the spindle 190 (or another cartridge 300 as will be described hereinafter) by disposing the feet 346 within the detents 196 formed in the spindle 190. In effect, the feet 346 are male locking members that mate with the detents 196 that serve as female locking members, as will be described.

The drive spindle 340 also includes drive features formed at the first end 342. More specifically, the drive spindle 340 has a drive section 350 formed at the first end 342 that has greater dimensions relative to the base section 342 so that a shoulder 345 is formed between the drive section 350 and the base section 342. The drive section 350 can be thought of a ring-shaped member since the bore 341 defines an inner surface thereof and an outer surface extends beyond the base section 342.

The drive section 350 has an annular groove 352 formed therein to position and couple the drive spindle 340 to the housing 310 in a rotatable manner. The annular groove 352 is formed between the first end 342 and the shoulder 345 and preferably, the annular groove 352 is formed approximately half way between the first end 342 and the shoulder 345. The drive section 350 also has a plurality of radial grooves 354 formed therein which preferably extend from the first end 342 to the shoulder 345. In other words, the radial grooves 354 preferably extend the entire height of the drive section 350 and the radial grooves 354 traverse the annular groove 352. The annular groove 352 thus partitions the drive section 350 into two sections with one section including the first end 342 and the other section including the shoulder 345.

The base section 350 has an outer diameter that is approximately equal to an inner diameter of the spool bore 330 so that the drive spindle 340 can be disposed within the spool bore 330 and a frictional fit results therebetween to ensure that the spool 320 rotates simultaneously with the drive spindle 340 when the drive spindle 340 is driven. Rotation of the drive spindle 340 is the means by which the spool 320 is rotated and therefore it is not desirable for the fit therebetween to be loose since this will result in excessive slippage of the spool 320 when the drive spindle 340 is rotated. As best shown in FIGS. 3 and 5, when the drive spindle 340 is disposed within the spool bore 330, the feet 346 do not extend beyond the flange member 326. In other words, the distal ends of the feet 346 remain disposed within the spool bore 330. Preferably, the distal ends of the feet 346 extend near or to the end of the spool bore 330.

The drive spindle 340 is also locked into place relative to the housing 310 by means of the annular groove 352. More specifically, the thickness of the upper face 312 of the housing 310 is about equal to the width of the annular groove 352 and this permits a portion of the upper face 312 to be received within the annular groove 352 in a frictional manner so that the two components are securely coupled to one another. However, the drive spindle 340 is still free to rotate relative to the housing 310, including the upper face 312. The drive spindle 340 is thus inserted partially through the opening 315 formed in the upper face 312 so that a peripheral edge of the upper face 312 that is defined around the opening 315 is disposed within the annular groove 352. The outer diameter of the drive section 350 as defined within the annular groove 352 is thus slightly less than the diameter of the opening 315 formed in the upper face 312 to permit the drive spindle 340 to freely rotate relative to the housing 310, while at the same time, the upper face 312 restricts movement of the drive spindle 340 by effectively locating and holding it in an axial position. Thus, the section of the drive section 350 defined between the annular groove 352 and the shoulder 345 is disposed between the upper face 312 and the top flange member 324. As will be described in greater detail hereinafter, the feet 346 are male drive members for rotatably driving the drive spindle 340, thereby driving the spool 320. In other words, motion from a drive member that is being rotated from below the cartridge 300 is transferred to rotation of the feet 346. The radial grooves 354 function as female drive members since they are designed to receive and securely hold feet 346 of a drive spindle 340 that is associated with a cartridge 300 that may be stacked above and secured to the cartridge 300. In other words, the feet 346 and the radial grooves 354 comprise a means for coupling the two drive spindles 340 together such that the drive motion of one drive spindle 340 is imparted to the other drive spindle 340.

The cord 400 is of a type that is commonly used with these type of hair wrapper devices. For example, the cord 400 can be formed of a synthetic material, such as a nylon thread, or the it can be formed of a natural material, such as a cotton thread. The cord 400 is wrapped around the base section 322 and has a first end that is attached to the base section 322 using conventional techniques, such an adhesive or by a mechanical fit between the cord end and the base section 322 and an opposing second end 401 that is a free cord end.

Figure 2:
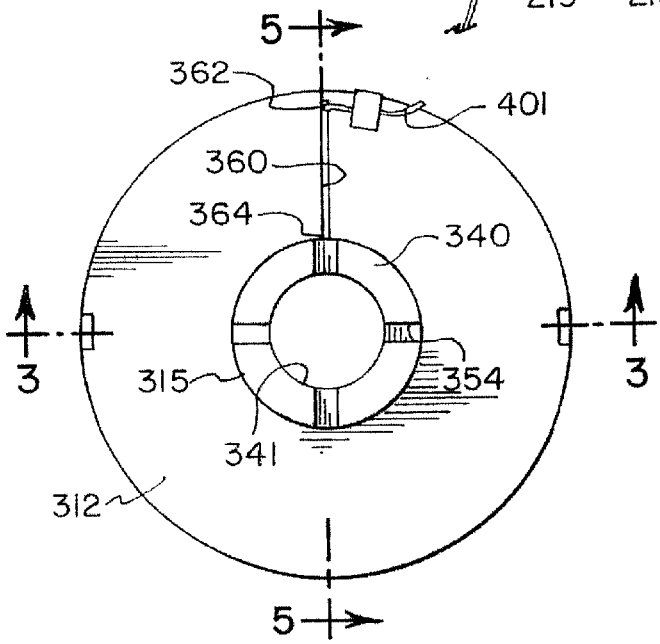
FIG. 2 is a top plan view of one stackable cord cartridge according to a first embodiment.
Figure 10:
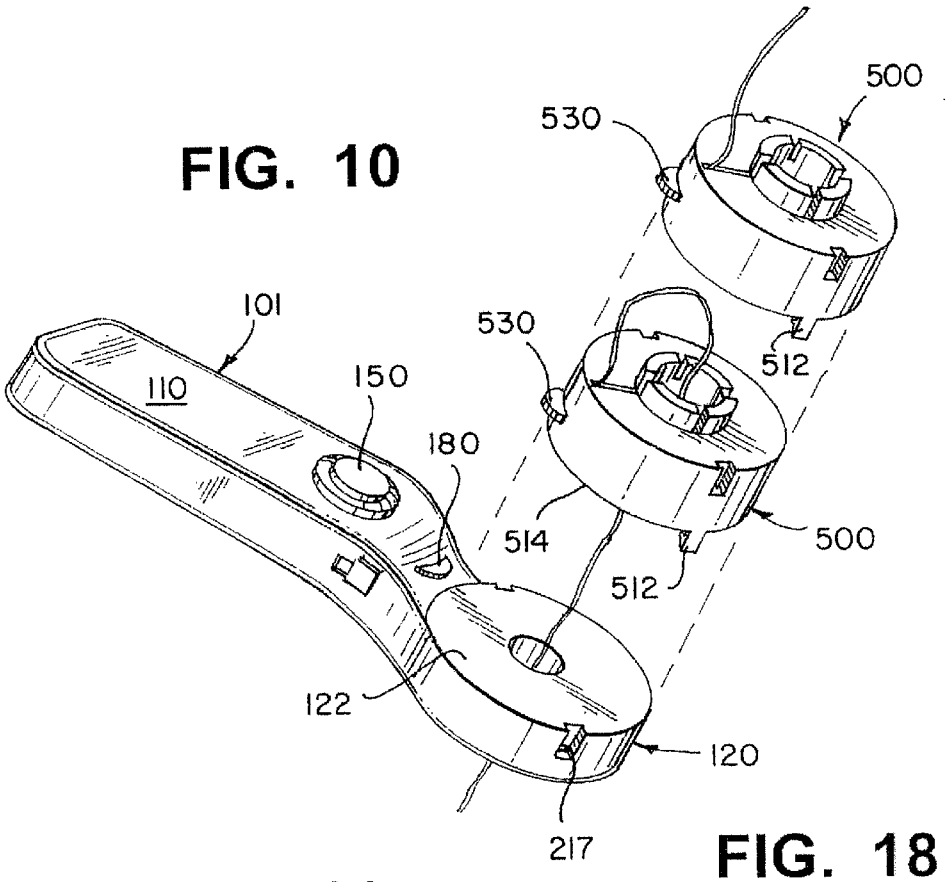
FIG. 10 is an exploded perspective view of a hair wrapper device with a plurality of stackable cord cartridges according to a second embodiment.

The cartridge 300 of the disclosed embodiment also has a cord slot 360 formed in the upper face 312 for receiving the cord 400. As best shown in FIG. 2, the cord slot 360 is an elongated slot formed completely through the upper face 312 of the housing 310 and includes a first end 362 that is located near the intersection of the upper face 312 and the side 316. The cord slot 360 also has an opposing second end 364 that extends to the opening 315 formed in the upper face 312 such that the second end 364 defines an entrance to the opening 315. In addition, the cord slot 360 can be axially aligned with one of the radial grooves 354 by rotating the drive spindle 340 into such position to permit the axial alignment. Referring to FIGS. 2 and 5, the second free end 401 of the cord 400 is shown looped up over the top flange member 324 into the cord slot 360 and then affixed to the upper surface of the upper face 312 using conventional techniques, such as using a small piece of tape. In this manner, the user can visually see what type of cord 400 is disposed within the cartridge 300 (assuming that the cartridge housing is not transparent or translucent). For example, the color of the cord 400 can readily be determined by looking at the second end 401 that is releasably affixed to the upper face 312. By having the second free end 401 affixed to the upper face 312, a length of cord 400 can easily be dispensed by detaching the cord 400 from the upper face 312 and then pulling the free second end 401 so as to rotate the spool 320 and unwind a length of the cord 400 from the spool 320.

In another aspect, the cartridge 300 includes one or more detents 370 formed therein along the side 316 of the housing 310 (see FIG. 1). The detents 370 are similar to and preferably identical to the detents 217 formed in the spindle base section 120. More specifically, the detent 370 is a recessed rectangular element that includes an opening or slot 372 that forms an entrance into the interior chamber of the cartridge 300. The detent 370 therefore functions as a female snap member and receives one tang 212 in a releasable yet interlocking manner. According to one exemplary embodiment, each cartridge 300 includes a pair of tangs 212 that are arranged about 180° apart and also includes a pair of detents 370 that are formed in the side 316 of the housing 310. Because tangs 312 of another cartridge 300 are interlockingly received within the detents 370 of the cartridge 300, detents 370 are also orientated 180° apart and also more specifically, the detents 370 are located above the tangs 212 so that a plane perpendicular to the housing 310 passes through the pair of detents 370 and also through the pair of tangs 212. The detent 370 terminates in one end with a ledge 373 which is below the opening 372 so that the user can grasp the distal end of the tang 212 and pull outwardly so as to disengage the locking feature 213 from the opening 372.

Because the distance between the top flange member 324 and the lower surface of the upper face 312 of the housing 300 is minimal, the movement of the cord 400 is restricted due to the dimensions of the spacing between these two surfaces. Because the dimensions of the spacing are only slightly greater than the diameter of the cord 400 and also once the cord 400 is disposed within one radial groove 354, the height of the walls defining the radial groove 354 prevent the cord 400 from becoming displaced from one radial groove 354 since there is no gap or space between the radial groove 354 and the upper face 312 of sufficient size to permit the cord 400 to become displaced from the radial groove 354. Thus, these structural features represent a means for securely holding the cord 400 within the detent 354 to thereby ensure that the cord 400 rotates with the drive spindle 340 and the spool 320.

The coupling of one cartridge 300 to the hair wrapper device 300 and also the coupling between cartridges 300 (when the cartridges 300 are stacked) will now be described. The lowermost cartridge 300 is first prepared by detaching the free second end 401 of the cord 400 from the upper face 312 and pulling the second end 401 slightly so that a length of the cord 400 is unwound from the spool 320. The unwound length of the cord 400 is then looped back over the upper face 312 and is inserted into one of the radial grooves 354 of the drive section 350 and then the second end 401 is disposed through the opening 315 of the upper face 312 and is then threaded through the entire length of the drive spindle bore 341 and is then disposed through the opening 317 so that a length of cord 400 extends below the lower face 314 of the housing 310. FIG. 5 illustrates the cord 400 in two positions, namely a first position in which the cord 400 is shown in phantom and is being looped over the upper face 312 and threaded through the spindle bore 341. In the second position, the cord 400 has been threaded through the spindle bore 341 and the slack in the cord 400 has been removed by applying tension to the cord 400 (e.g., pulling the cord 400). In this tensioned position, the cord 400 lies across the top flange member 324 and within one of the radial grooves 354 and then finally through the spindle bore 341.

The length of cord 400 that extends below the lower face 314 of the housing 310 is then fed into and through the spindle bore 192 and the cord 400 is free to extend below the hair wrapper device 100.

The cartridge 300 is then releasably interlocked with the hair wrapper device 100 by inserting the tangs 212 into detents 217 such that the locking features 213 of the tangs 212 engage and interlock with the openings or slots 219 formed in the detents 217. Concurrently, the drive spindle 340 of the cartridge 300 is orientated so that the teeth 346 thereof mesh with and releasably interlock with the detents 196 of the spindle 190. The teeth 346 are received within the detents 196 in such away (e.g., frictional/mechanical fit) that results in the two parts being securely mated to one another. Because of this type of interlocking fit, the driving of the spindle 190 is directly translated into the drive spindle 340 being driven without the drive spindle 340 excessively losing transferred energy due to slipping or the like by the drive spindle 340.

With the cord 400 lying within one of the radial grooves 354 and being disposed through the drive spindle bore 341 and the spindle bore 192 of the spindle 190, the cartridge 300 is releasably interlocked to the spindle base section 120. When the tangs 212 interlock with the detents 217, the lower face 314 of the cartridge housing 310 seats against an upper edge 215 of the peripheral rim 214. It will be appreciated that the opening 317 formed in the lower face 316 is also of sufficient dimension so that the upper section 194 of the spindle 190 can be received therethrough to permit detents 196 to mesh and interlock with the feet 346. When the cartridge 300 is securely coupled to the spindle base section 120, there is preferably a relatively seamless flow between the two components. In other words, the lower face 314 flushly interfaces with the upper edge 215.

To release and unlock the cartridge 300 from the spindle base section 120, the user grasps the distal ends of the tangs 212 and pulls the tangs 212 outwardly so as to disengage and release the locking features 213 thereof from the openings 219. As soon as the locking features 213 clear the openings 219, the cartridge 300 can be lifted upward and removed from the hair wrapper device 100. The user can then replace the removed cartridge 300 with another cartridge 300 by simply repeating the above steps.

FIG. 3 illustrates the exemplary cartridge 300 according to the first embodiment with the spindle 190 being shown in engagement with the drive spindle 340 by inserting the feet 346 into the detents 196. FIG. 4 illustrates a cross-sectional view taken through the cartridge illustrating the drive spindle 340 and the top flange member 324.

Some of the more common reasons that the cartridge 300 may need to be removed are that the cartridge 300 is running low of cord 400; the cartridge 300 is experiencing mechanical problems or the user desires to dispense a cord 400 having different characteristics, e.g., texture, color, etc.

Alternatively, the user may desire to stack a number of cartridges one on top of another so as to permit multiple cords to be wrapped around a lock of hair. This is a substantial advantage of the present hair wrapper assembly 10 in comparison to traditional devices which have no such capabilities. Once the bottommost cartridge 300 has been securely interlocked with the hair wrapper device 100, with the cord 400 associated therewith extending through the drive spindle bore 341 and the spindle bore 192, another cartridge 300 is disposed on top of and interlocked to the bottommost cartridge 300 in the following manner.

The interlock coupling of the two cartridges 300 is very similar to the interlocking of one cartridge 300 to the spindle 190 as is best shown with reference to FIGS. 1 and 7–9. FIG. 7 illustrates two cartridges 300 securely interlocked with respect to one another. FIG. 7 also illustrates the upper section 194 of the spindle 190 being engaged with the drive spindle 340 of the bottommost cartridge 300; however, the tangs 212 of the bottommost cartridge 300 are not shown in this sectional view, though they are arranged to be engaged with the spindle base section 120 of the hair wrapper device 100 as previously described.

After the bottommost cartridge 300 is interlocked with the spindle base section 120 and the cord 400 of this cartridge 300 extends through the spindle bore 192, the second cartridge 300 is interlockingly mated with the bottommost cartridge 300 by first detaching the cord 400 from the upper face 312; placing the cord 400 with the cord slot 360; and manipulating the drive spindle 340 until one of the radial grooves 354 is in axial alignment with the cord slot 360 to permit the second end 401 of the cord 400 to be looped over, into and through the spindle bore 341. Tension is then applied to the cord 400 and it is drawn (i.e., pulled) through the spindle bore 341 until a predetermined length extends below the lower face 314 of the cartridge housing 310. Enough cord 400 extends below the lower face 314 to permit this length of cord 400 to be inserted into the top of the spindle bore 341 of the bottommost cartridge 300 and through the spindle bore 192 of the spindle 190 to which the drive spindle 340 of the bottommost cartridge 300 is attached. In other words, the cord 400 of this second cartridge 300 extends not only through its spindle bore 341 but also through the spindle bore 341 of the cartridge 300 disposed there underneath and the spindle bore 192 of the spindle 190 with a predetermined length of the cord 400 extending below the hair wrapper device 100. Accordingly, not only is there a length of cord 400 of the bottommost cartridge 300 extending below the hair wrapper device 100 but also there is a length of cord 400 associated with the second cartridge 300 that extends below the hair wrapper device 100.

After the cords 400 are properly threaded through the respective bores, the second cartridge 300 is releasably interlocked with the bottommost cartridge 300. The tangs 212 extending from the lower face 314 of the second cartridge housing 310 are flexed outwardly and are aligned with the detents 370 formed in the housing 310 of the bottommost cartridge 300. The tangs 212 are then inserted into the top section of the detents 370 and the second cartridge 300 is pushed downward until the locking features 213 of the tangs 212 engage and are received within the openings 372 formed in the detents. Once the locking features 213 encounter the openings 372, the natural inward biasing action of the tangs 212 causes the locking features 213 to be received within the openings 372 in a snap fit manner so as to releasably interlock the second cartridge 300 to the bottommost cartridge 300.

When the second cartridge 300 is interlocked with the bottommost cartridge 300, the cords 400 of the two cartridges 300 extend through the spindle bore 314 associated with the bottommost cartridge 300 and also extend through the spindle bore 192 of the spindle 190. For purpose of illustration only the below description of the use of the hair wrapper device 100 describes the device being used with two cartridges 300 (the second and bottommost cartridges); however, it will clearly be appreciated that additional cartridges 300 can be stacked on top of one another. For example, a third cartridge 300 having a cord of the same type of different type (e.g., different color) can be stacked on top and releasably interlocked with the second cartridge 300.

After the cords 400 of the two cartridges 300 are fed through the spindle bore 192, a lock of hair to be wrapped is inserted in the slot 56 on the bifurcated hair feeding tool 54. The tool 54 is then pushed down through the spindle bores 341 of the cartridges 300 and the spindle bore 192 along side the cords 400. By simply sliding the hair out of the slot 56, the tool 54 can be withdrawn from the spindle bores 341, 192.

By pushing the button 150, the electrical circuit is closed and the motor 140 is energized to rotate the spindle 190 through the gear mesh. When the spindle 190 rotates and because the bottommost cartridge 300 is directly coupled to the spindle 190, the rotation of the spindle 190 is translated into direct rotation of the drive spindle 340 of the bottommost cartridge. Further, when additional cartridges 300 are stacked on top of the bottommost cartridge 300, all of the drive spindles 340 are interconnected to one another so that rotation of the drive spindle 340 of the bottommost drive spindle 340 is translated into rotation of the other drive spindles 340. As each of the drive spindles 340 rotates, the radial grooves 354 of the drive spindle 340 rotate, as well, to dispense the cord 400 from the spool 320 and wrap the hair with the cords 400. As the cords 400 are being wrapped around the hair, it is desirable to pull the hair out the spindle bore 192 slowly so that the hair is wrapped along the desired length. Further slow pulling will result in a closer wrap than a quicker pull.

Figure 18:
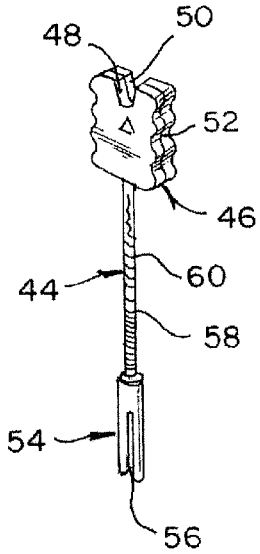
FIG. 18 is a perspective view of a bifurcated tool for feeding hair through the hair wrapping device of FIGS. 1 and 10 and for cutting the cord.

When the hair is wrapped to the desired amount and appearance, the hair is pulled out of the spindle bore 192 completely and the cords 400 are cut with scissors or by sliding the cords 400 into a cutting device's tapered guides 48 against a razor 50 (see FIG. 18). The ends of the cords 400 can be tied, clipped, or beaded together to ornamentally secure the wrapping or another color or texture of cord can be wrapped on and tied to the previously wrapped cords 400.

FIGS. 10–16 illustrate a cartridge 500 according to another embodiment. The cartridge 500 has a number of similarities to the cartridge 300 with one being that both cartridges 300, 500 are of a stackable configuration and are also designed to mate with the hair wrapper device 101 to permit dispensing of cord 400 contained in each cartridge 500. The hair wrapper device 101 is very similar to the hair wrapper device 100 of FIG. 1 with the main exception being the elimination of the spindle 190 and the idler gear 180 being partially visible when one cartridge 500 is not present in the spindle base section 120.

One difference between the cartridge 500 and the cartridge 300 is the manner in which the moving components are rotated by the motor 140. According to this embodiment, the spindle 190 is eliminated and when the cartridge 500 is releasably interlocked with the spindle base section 120, a lower face 514 of a housing 512 seats against the floor 122 instead of being elevated therefrom as in the first embodiment. The detent 217 lies below the floor 122 so that when the cartridge 500 sits on the floor 122, the tangs 212 thereof engage the detents 217 in a snap-fit manner.

According to this second embodiment, at least a portion of the idler gear 180 is exposed in the spindle base section 120 and more particularly, the idler gear 180 is disposed slightly above the floor 122. The cartridge 500 also includes a gear slot 510 formed in a side 516 of the housing 512 at a lower section thereof near the lower face 514 of the housing 512.

Figure 11:
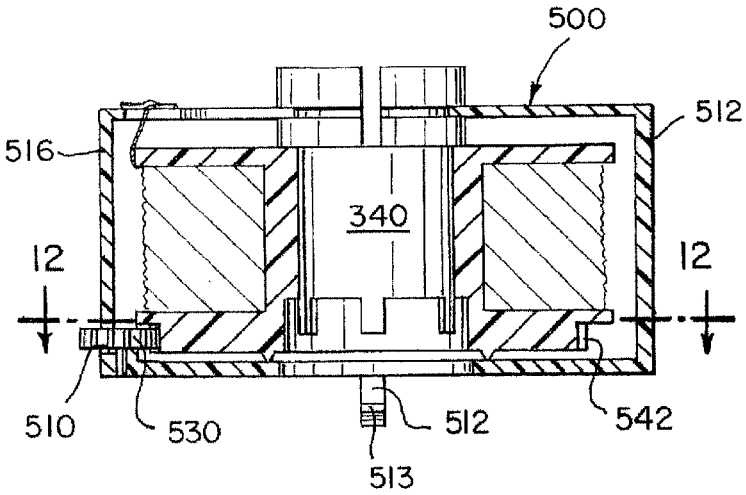
FIG. 11 is a cross-sectional view of one cord cartridge according to the second embodiment and coupled to a drive mechanism of the hair wrapper device of FIG. 10.
Figure 12:
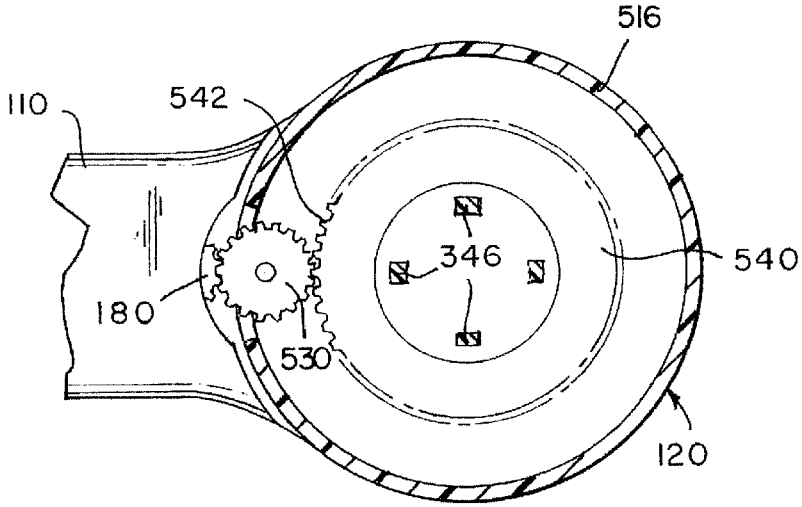
FIG. 12 is a cross-sectional view taken along the line 12—12 of FIG. 11.
Figure 13:
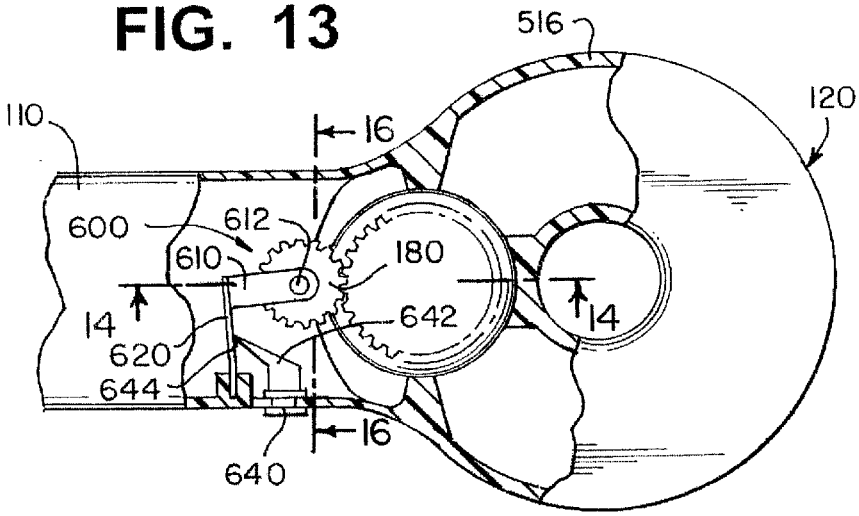
FIG. 13 is a sectional view of a portion of a cord cartridge according to another embodiment and coupled to a drive mechanism of another exemplary embodiment.
Figure 14:
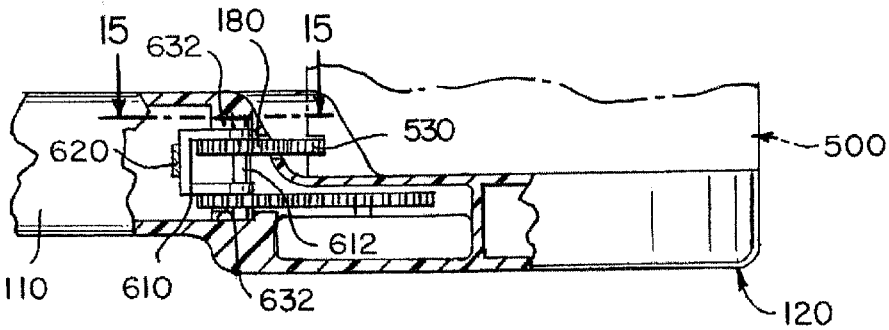
FIG. 14 is a cross-sectional view taken along the line 14—14 of FIG. 13.

The cartridge 500 also includes a gear 530 which is rotatably mounted in the cartridge housing 512 near the side 516 in facing relationship to the gear slot 510. The gear 530 can be rotatably mounted on a pin or post that is disposed within an interior section of the housing 512. The gear 530 is complementary to the idler gear 180 and meshes therewith when the cartridge 500 is interlocked to the hair wrapper device. As best shown in FIGS. 11 and 12, the gear 530 also meshes with a gear base 542 (e.g., teeth) of a rotatable spool 540 so that rotation of the gear 530 causes the spool gear base 542 to rotate.

The gear 530 is disposed at least partially within the gear slot 510 and more specifically, a portion of the gear 530 extends beyond the side 516 of the housing 512 to permit the gear 530 to engage and intermesh with the idler gear 180. As best shown in FIG. 12, when the cartridge 500 is in the proper locked position, the gear 530 intermeshes with both the idler gear 180 and the gear 542 of the spool 540 so as to translate the drive action of the idler gear 180 into rotation of the spool 540.

As will be appreciated, according to this embodiment, the rotatable spool 540 is the member that is driven by the motor 140 through the various gears, including the idler gear 180.

Because the drive spindle 340 is driven by rotation of the rotatable spool 540, the drive spindle 340 of the bottommost cartridge 500 can drive the other drive spindles 340 of other cartridges 500 stacked on top of the bottommost cartridge 500. This results in the spools 540 of each of the other cartridges 500 being rotated since the drive spindles 340 and the spools 540 are intimately coupled to one another and accordingly, the cords 400 are dispensed as a result of the rotation of the spools 540, just as they are dispensed in the first embodiment. The meshing between the drive spindle 340 of the bottommost cartridge 500 and the second cartridge 500 and the meshing between the drive spindles 340 in the other stacked cartridges 500 is in the same manner as in the first embodiment in that the feet 346 of one cartridge 500 mesh with the radial grooves 354 of other cartridge 500. This results in an effective coupling between the drive components of the cartridges 500 and interconnects the drive spindles 340 of all of the stacked cartridges so that the rotation of the idler gear 180 is translated into the drive spindles 340 being driven.

It will be appreciated that each of the cartridges 500 can include the gear slot 510 to simplify manufacturing of the cartridge and then selection and arrangement on the device 101 by a user. Thus, if the cartridge 500 ends up being stacked above the bottommost cartridge 500 and therefore not directly coupled to the idler gear 180, then only the gear slot 510 of the bottommost cartridge 500 will be utilized by receiving the idler gear 180 therethrough to allow intermeshing between the idler gear 180 and the gear 530.

It will also be appreciated that a mechanism can be provided to ensure that the idler gear 180 properly intermeshes with the gear 530 so that drive energy is not wasted due to an incomplete or less the effective coupling between gears 180, 530. For example, when the cartridge 500 is interlocked to the spindle base section 120 on top of the floor 122, the teeth of the gears 180, 530 may not be completely intermeshed and engaged. Therefore, it would be advantageous for the hair wrapper device 100 to have some type of mechanism that biases the idler gear 180 towards the gear 530 to ensure that the gears 180, 530 intermesh. Proper intermeshing between the gears 180, 530 results in better translation of rotational movement from one movable of one cartridge to another movable part of another cartridge. In one exemplary embodiment, the mechanism is a spring-biasing device having a slidable dial or button or the like to cause the biasing of the gear 180 or the release of the biasing force when the user wishes to disengage and remove the bottommost cartridge 500 from the hair wrapper device 100.

Figure 15:
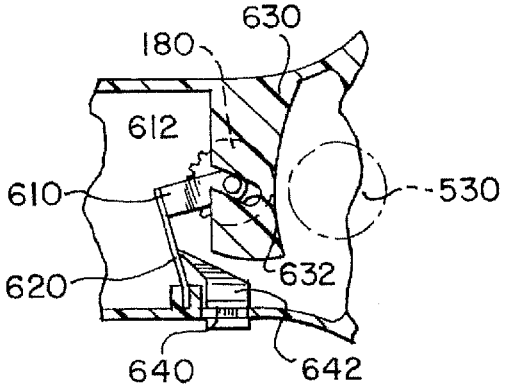
FIG. 15 is a cross-sectional view taken along the line 15—15 of FIG. 14.
Figure 16:
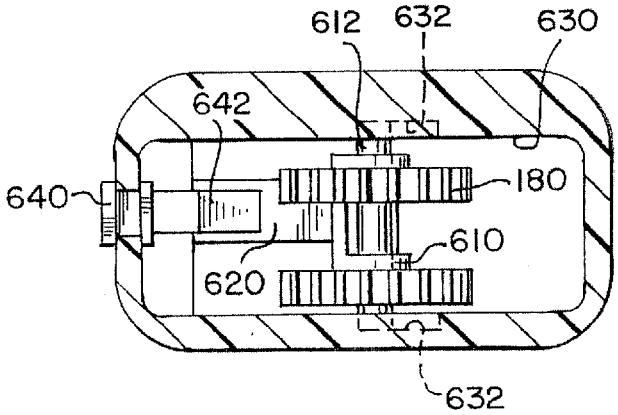
FIG. 16 is a cross-sectional view taken along the line 16—16 of FIG. 13.

For example, one exemplary mechanism is illustrated in FIGS. 13–16 and is generally indicated at 600. The mechanism 600 includes an arm 610 and a resilient biasing beam 620 for applying a biasing force against the gear 180. One end of the biasing beam 620 is securely attached to a housing wall and the other end is connected to the arm 610 that extends outwardly therefrom. At an opposite end of the arm 610, a pivot post or pin 612 is provided, with the gear 180 rotatatably mounted thereon. As best shown in FIG. 15, the housing includes an upper interior surface 630 that extends across an interior section of the housing. The surface 630 has a slot 632 formed therein with the pivot post 612 being disposed therein. The pivot post 612 thus rides within the slot 632 as the arm 610 applies a biasing force against the gear 180. In a normal position, the arm 610 and beam 620 are biased (e.g., spring biased) so that a force is applied to the gear 180 in the direction towards the spindle base section 120.

The mechanism 600 further includes an adjustable lever 640, with a portion of which is disposed through an opening formed in the housing to permit the user to access and manipulate the lever 640. The lever 640 has an beveled section 642 that terminates in a pointed end 644. The lever 640 is beveled towards the beam 620 such that the pointed end 644 is spaced close to or in contact with the beam 620. FIG. 15 illustrates the position of the relative parts after the user has manipulated the lever 640 and caused the pointed end 644 of the lever 640 to contact and displace the flexibly biasing beam 620. As a result of this force being applied and the flexing of the biasing beam 620, the pivot post 612 rides with the slot 632 to one end thereof. This driving action of the gear 180 causes the gear to move away the distal end of the housing. This action is particularly useful when the user is placing or removing a cartridge 500 from the housing since it permits the intermeshing between the gears 180, 530 to be released when the cartridge 500 in interlocked to the housing or it permits the gear 180 to be moved to a receiving position that permits the cartridge 500 to be received in the housing without any undue interference between the gears 180, 530. Once the cartridge 500 is in place (e.g., interlocked to the housing), the user simply releases the lever 640 and the natural biasing force of the mechanism 600 causes the gear 180 to be biased into an intermeshing fit with the gear 530.

It will be appreciated that the cartridge 300, 500 stacked on top of the bottommost cartridge 300,500 can include a cord 400 of the same type (texture) and color as the cord 400 of the bottommost cartridge 300, 500 if the user simply wants a double wrap of the same cord.

The cartridges 300, 500 optionally can be provided with a spool tensioning element to impart tension to the spool 320 within the cartridge. The tension can comprise a foam or other pad, a leaf spring (e.g., upwardly depending from bottom surface of the cartridge), a split washer or the like. These elements are well known and are not illustrated for clarity.

Each hair wrapper assembly provides the user with a hair wrapper device that is configured to receive one or more cartridges that are each configured to mate with either the hair wrapping device itself or another cartridge so that the user can selectively decide the number of cords to wrap around the hair and/or the colors and texture of the cords. The present cartridge assemblies overcome the deficiencies of the prior art by permitting the user to stack multiple cartridges that are coupled to the drive mechanism of the hair wrapper device so that the cords that are contained in the cartridges can be wrapped around the hair. The cartridges are also easily interlocked with the hair wrapper device and likewise, the cartridges can easily be removed from the hair wrapper device to permit the user to change one cartridge for another or to dispose of the cartridge when the cord contained therein runs out.

While the invention has been particularly shown and described with reference to preferred embodiments thereof, it will be understood by those skilled in the art that various changes in form and details can be made without departing from the spirit and scope of the invention.

What is claimed is:

1. An apparatus for wrapping hair with a cord, comprising:

a housing;

first gearing operatively coupled to the housing and defining a main bore for receiving cord and hair; and one or more cartridges operatively coupled to the first gearing, each cartridge including second gearing and a rotatable spool for dispensing cord, the rotatable spool being driven by the second gearing which has a bore for receiving hair and cord from the spool, the second gearing having a guide for receiving the cord and permitting the cord to be disposed through the bore of the second gearing, wherein when hair is disposed through the main bore and the bore of the second gearing and when the cord is disposed through the main bore, the bore in the second gearing and the guide, rotation of the first gearing causes the cord to wrap about the hair.

2. The apparatus of claim 1, wherein first gearing comprises a main spindle that is operatively coupled to the housing and has a first drive coupling feature formed at one end.

3. The apparatus of claim 2, wherein the second gearing comprises a drive spindle that includes a second drive coupling feature that mates with the first drive coupling feature when the cartridge releasably interlocks with the housing for translating rotation of the main spindle into rotation of the drive spindle.

4. The apparatus of claim 3, wherein the housing includes a spindle base section having a floor with an opening formed therein, the main spindle extending through the opening so that the first drive coupling feature is disposed at least partially above the floor and the spindle bore is axially aligned with the housing opening.

5. The apparatus of claim 4, wherein the spindle base section includes a peripheral rim that extends around and above the floor.

6. The apparatus of claim 3, wherein the main spindle is operatively coupled to a gear mesh for transmitting rotation to the main spindle.

7. The apparatus of claim 6, further including:

a motor having a rotating shaft that is coupled to the gear mesh for transmitting rotation of the rotating shaft to the main spindle; and a switch for activating the motor.

8. The apparatus of claim 3, wherein the first drive coupling feature comprises a plurality of detents formed at a distal end of the main spindle and the second drive coupling feature comprises feet formed at one end of the drive spindle, the feet being intimately received within the detents so as to couple the main spindle and the drive spindle to one another.

9. The apparatus of claim 3, wherein the drive spindle includes a third drive coupling feature formed at an end opposite the second drive coupling feature, the third drive coupling feature being complementary to the second drive coupling feature so that the second drive coupling feature of the drive spindle of one cartridge can intimately mate with the third drive coupling feature of drive spindle of another cartridge so as to rotatably link the drive spindles of the two cartridges to one another.

10. The apparatus of claim 9, wherein the third drive coupling device includes a plurality of radial grooves that are shaped to intimately receive feet which comprise the second drive coupling feature and extend outwardly from one end of the drive spindle, the feet meshing with the plurality of radial grooves so as to releasably interlock one drive spindle to the other drive spindle.

11. The apparatus of claim 10, wherein the cartridge has a housing including an upper wall having an opening formed therein to receive the drive spindle such that a portion of the drive spindle extends above the upper wall and the drive spindle has an annular groove formed at one end that receives a part of the upper wall that defines the opening to securely couple the drive spindle to the housing while still permitting rotation of the drive spindle relative to the housing, and wherein the annular groove extends around the radial grooves so as to partition the radial grooves into a first section lying above the annular groove and a second section lying below the annular groove.

12. The apparatus of claim 3, wherein the cartridge has a housing including an upper wall having an opening formed therein to receive the drive spindle such that a portion of the drive spindle extends above the upper wall and the drive spindle has an annular groove formed at one end that receives a part of the upper wall that defines the opening to securely couple the drive spindle to the housing while still permitting rotation of the drive spindle relative to the housing.

13. The apparatus of claim 3, wherein the spool has a bore extending therethrough which receives the drive spindle such that a frictional fit results between the spool and the drive spindle to permit rotation of the drive spindle to be translated into rotation of the spool.

14. The apparatus of claim 3, wherein an upper wall of a cartridge housing has an opening formed therein for receiving a portion of the drive spindle, the upper wall further having a cord slot formed therein for receiving one end of the cord from the spool, wherein one end of the cord slot is open to the opening formed in the upper wall to permit the cord to be inserted into the slot formed in the drive spindle and fed into and through the drive spindle bore.

15. The apparatus of claim 14, wherein in a stored position, the cord is releasably secured to the upper wall of the cartridge by passing through the cord slot to the upper wall and in an operating position, the cord is disposed between an upper face of the spool and the upper wall as it extends across the upper face of the spool, through the slot of the drive spindle and into and through the drive spindle bore.

16. The apparatus of claim 14, wherein a portion of the slot of the drive spindle that is disposed above an upper face of the cartridge forms a part of a third drive coupling feature that is complementary to the second drive coupling feature so that the second drive coupling feature of the drive spindle of one cartridge can intimately mate with the third drive coupling feature of a drive spindle of another cartridge so as to rotatably link the drive spindles of the two cartridges to one another.

17. The apparatus of claim 1, wherein the cartridge has a first interlocking feature for releasably coupling the cartridge to the housing.

18. The apparatus of claim 17, wherein the housing includes a second interlocking feature formed therein to releasably interlock with the first interlocking feature, resulting in the cartridge being releasably interlocked with the housing.

19. The apparatus of claim 18, wherein the first interlocking feature comprises one or more tangs extending outwardly from the cartridge and the second interlocking feature comprises a detent formed in the housing to engage and interlock with the first interlocking feature in a snap fit manner.

20. The apparatus of claim 1, wherein a second locking feature is formed in the housing of the cartridge to releasably interlock with the first interlocking feature of another cartridge, resulting in the two cartridges being releasably interlocked with one another.

21. The apparatus of claim 20, wherein the first interlocking feature comprises one or more tangs extending outwardly from the other cartridge and the second interlocking feature comprises a detent formed in the housing of the one cartridge to engage and interlock with the first interlocking feature in a snap fit manner so as to releasably interlock one cartridge to the other cartridge.

22. The apparatus of claim 1, wherein the one or more cartridges comprises a plurality of cartridges, each of the cartridges being coupled to the first gearing such that actuation of the first gearing is translated into movement of the second gearing of each cartridge.

23. An apparatus for wrapping hair with a cord, comprising:

a housing;

a first gear operatively coupled to the housing such that the first gear is rotatably driven; and a cartridge including a drive spool having a drive gear formed as part thereof which is operatively coupled to the first gear so that the drive spool is driven by rotation of the first gear, the drive spool being coupled to a drive spindle that includes a drive spindle bore for receiving hair and cord from the spool, the drive spindle having a guide for receiving the cord and permitting the cord to be disposed through the drive spindle bore, the rotation of the drive spool causing cord to be dispensed through the guide and the drive spindle bore, hair is disposed through the drive spindle bore, and the drive spool is rotated to wrap the hair with cord.

24. The apparatus of claim 23, wherein the cartridge has a first interlocking feature for releasably coupling the cartridge to the housing.

25. The apparatus of claim 23, further including:

a second gear disposed within a housing of the cartridge for intermeshing with the first gear and the drive gear of the drive spool.

26. The apparatus of claim 23, wherein the drive gear is formed as a bottom section of the drive spool.

27. The apparatus of claim 23, wherein the drive spindle is disposed within a bore of the drive spool to form a frictional fit between the drive spindle and the drive spool.

28. The apparatus of claim 23, wherein the first interlocking feature comprises one or more tangs extending outwardly from the cartridge and the second interlocking feature comprises a detent formed in the housing to engage and interlock with the first interlocking feature in a snap fit manner.

29. The apparatus of claim 23, wherein the guide is a slot.

30. The apparatus of claim 23, further comprising:

a second cartridge coupled to the cartridge so that the drive spindle of the cartridge rotates a drive spool of the second cartridge.

31. The apparatus of claim 23, wherein the housing includes an opening that communicates with the drive spindle bore to pass hair and cord therethrough.

* * * * *